US009759404B2

(12) United States Patent
Gomi

(10) Patent No.: US 9,759,404 B2
(45) Date of Patent: Sep. 12, 2017

(54) LIGHT EMITTING DEVICE

(71) Applicant: NICHIA CORPORATION, Anan-shi (JP)

(72) Inventor: Keiichi Gomi, Chino (JP)

(73) Assignee: NICHIA CORPORATION, Anan-shi (JP)

( * ) Notice: Subject to any disclaimer, the term of this patent is extended or adjusted under 35 U.S.C. 154(b) by 203 days.

(21) Appl. No.: 14/838,369

(22) Filed: Aug. 28, 2015

(65) Prior Publication Data

US 2016/0061419 A1 Mar. 3, 2016

(30) Foreign Application Priority Data

Aug. 29, 2014 (JP) ..... 2014-176635

(51) Int. Cl.

| | |
|---|---|
| ***F21V 9/16*** | (2006.01) |
| ***F21V 11/12*** | (2006.01) |
| ***F21K 9/64*** | (2016.01) |
| *F21Y 101/00* | (2016.01) |
| *F21Y 115/30* | (2016.01) |

(52) U.S. Cl.

CPC ..... *F21V 11/12* (2013.01); *F21K 9/64* (2016.08); *F21Y 2101/00* (2013.01); *F21Y 2115/30* (2016.08)

(58) Field of Classification Search

CPC ..... F21V 11/12; F21K 9/64; F21Y 2101/00; F21Y 2115/30

See application file for complete search history.

(56) References Cited

U.S. PATENT DOCUMENTS

| | | | | |
|---|---|---|---|---|
| 6,188,132 | B1 * | 2/2001 | Shih | H01S 5/02252 257/706 |
| 2003/0142718 | A1 * | 7/2003 | Hayakawa | H01S 5/32341 372/108 |
| 2003/0230749 | A1 * | 12/2003 | Isobe | B23K 26/032 257/59 |
| 2008/0116473 | A1 * | 5/2008 | Sugiyama | H01L 33/483 257/98 |
| 2012/0224378 | A1 * | 9/2012 | Koike | C09K 11/7774 362/259 |
| 2014/0268787 | A1 * | 9/2014 | Nozaki | H01S 3/005 362/259 |
| 2015/0009703 | A1 * | 1/2015 | Morizumi | G02B 6/0008 362/553 |
| 2016/0250802 | A1 * | 9/2016 | Odaka | B29C 66/1224 156/275.5 |

FOREIGN PATENT DOCUMENTS

| | | |
|---|---|---|
| JP | 7-281062 | 10/1995 |
| JP | 2002-31773 | 1/2002 |

(Continued)

*Primary Examiner* — Ali Alavi

(74) *Attorney, Agent, or Firm* — Mori & Ward, LLP

(57) ABSTRACT

A light emitting device with improved safety in which leaking laser beam from a slit is converted into a visible light. A light emitting device includes a laser light source part and optical member that defines a slit. The optical member is disposed with the slit oriented on an optical path of the laser beam, while disposing a wavelength converting member on an inner wall defining the slit to convert a wavelength of the laser beam into a long-wavelength side visible light.

12 Claims, 9 Drawing Sheets

(56) References Cited

FOREIGN PATENT DOCUMENTS

| | | | |
|---|---|---|---|
| JP | 2008-124114 | | 5/2008 |
| JP | 2008-124117 | | 5/2008 |
| JP | 5228412 | B2 | 7/2008 |
| JP | 2008-300591 | | 12/2008 |
| JP | 4770796 | B2 | 12/2008 |

* cited by examiner

LIGHT EMITTING DEVICE

CROSS-REFERENCE TO RELATED APPLICATION

The present application claims priority under 35 U.S.C. §119 to Japanese Patent Application No. 2014-176635, filed Aug. 29, 2014. The contents of this application are incorporated herein by reference in their entirety.

BACKGROUND

Technical Field

The present disclosure relates to a light emitting device that outputs a laser beam through a slit.

Discussion of the Background

Light emitting devices that employ an LED have been used as light sources for signal devices and display of measuring boards, in place of fluorescent lamps and incandescent bulbs. Also, light emitting devices that employ an LED have become increasingly used also for luminaire for general domestic use. Meanwhile, light emitting devices that employ a semiconductor laser diode as a light source have been proposed (for example, see JP 2002-31773A, JP H07-281062A, and JP 4770796B).

Light emitting devices that employ a semiconductor laser diode as a light source are, for example, configured such that laser beam from the light source is irradiated on a diffusion plate to diffuse the laser beam while converting the wavelength by the fluorescent material applied on the diffusion plate, so as to emit visible light. Light sources using a semiconductor laser are small in size and have high power efficiency and can produce high output, in addition to those, they can emit light of clear color via a fluorescent material. Thus, light sources using a semiconductor laser have attracted a great deal of attention as the light sources for future lighting devices.

However, in conventional laser light emitting devices, the laser beam is emitted while controlling the beam diameter of laser beam with a slit provided in the laser light source part. Such a configuration may allow leakage of laser beam from the slit that then propagates as stray light, so that improvement in safety has been demanded.

SUMMARY OF THE INVENTION

The present disclosure is directed in view of the above circumstances, and an object is to provide a light emitting device in which safety is improved by converting the laser beam that is leaking from the slit into a visible light with high visibility.

A light emitting device according to one aspect of the present disclosure includes a laser light source part and an optical member provided with a slit. The optical member has a structure in which the slit is oriented on the optical path of the laser beam, and a wavelength converting member to convert the wavelength of the laser beam into a long-wavelength visible light is disposed on an inner wall of the slit.

The light emitting device according to one aspect of the present disclosure is provided with a wavelength converting member on the inner wall of the slit, so that the laser beam that is leaking from the slit as stray light can be converted by the wavelength converting member into a visible light with high visibility. Thus, safety can be improved while maintaining rectilinear advancing property of the laser beam irradiated through the slit.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
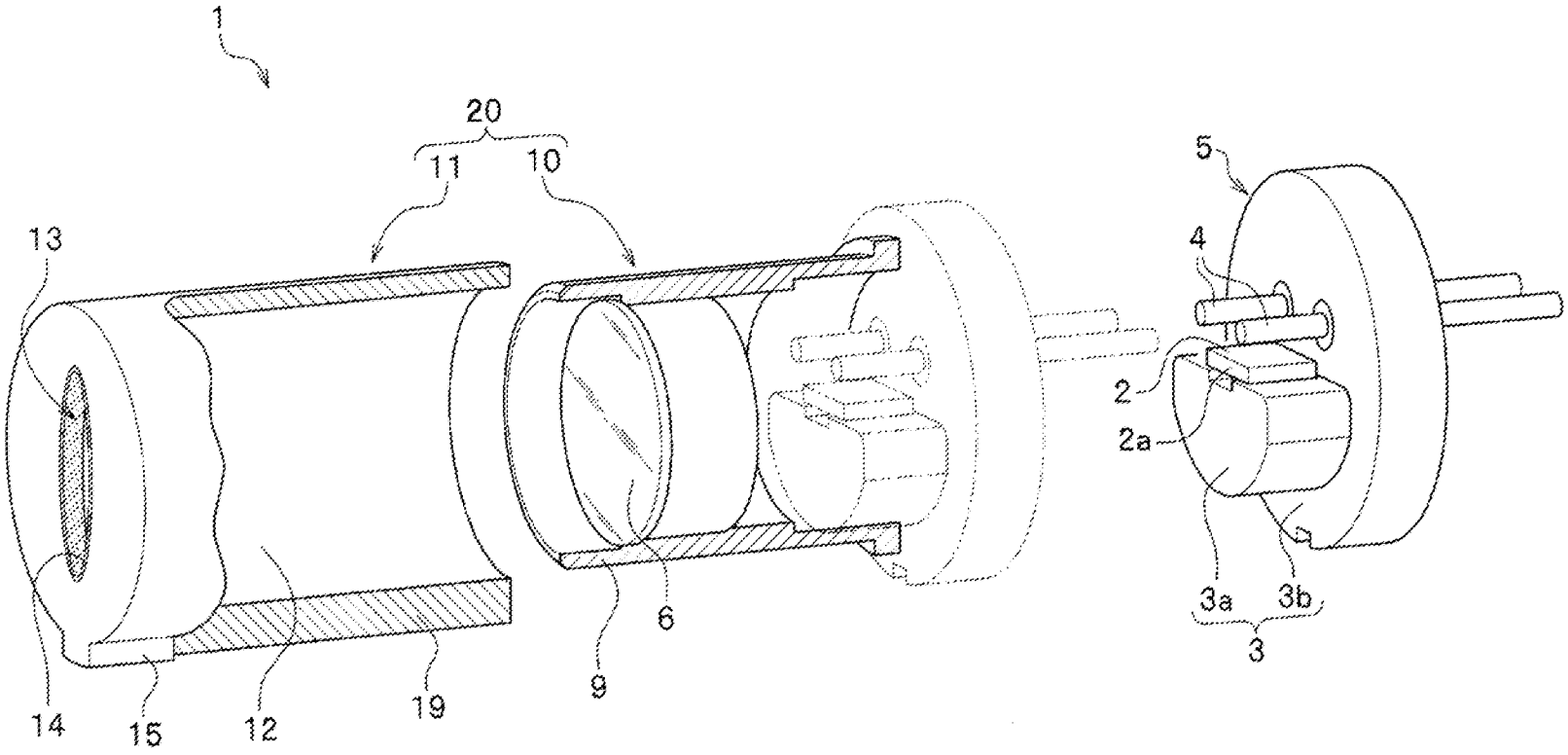
FIG. 1 is a schematic exploded perspective view showing a cross-section of a part of a light emitting device disclosed as one example of an embodiment of the present disclosure.

The embodiments according to the present invention will be described below with reference to the drawings. The embodiments shown below are intended as illustrative of a light emitting device to give a concrete form to technical ideas of the present disclosure. Accordingly, the embodiments of the present disclosure are not limited to those light emitting devices illustrated below. The sizes, materials, shapes and the relative configuration etc. of the members described in embodiments are given as an example and not as a limitation to the scope of the disclosure unless specifically described otherwise. The drawings referred to in the description below are to schematically illustrate the embodiments, and the size, a space or interval, locational relationship of the components may be exaggerated or a portion of a component may not be shown. In the description below, the same designations or the same reference numerals denote the same or like members and duplicative descriptions will be appropriately omitted.

Figure 2A:
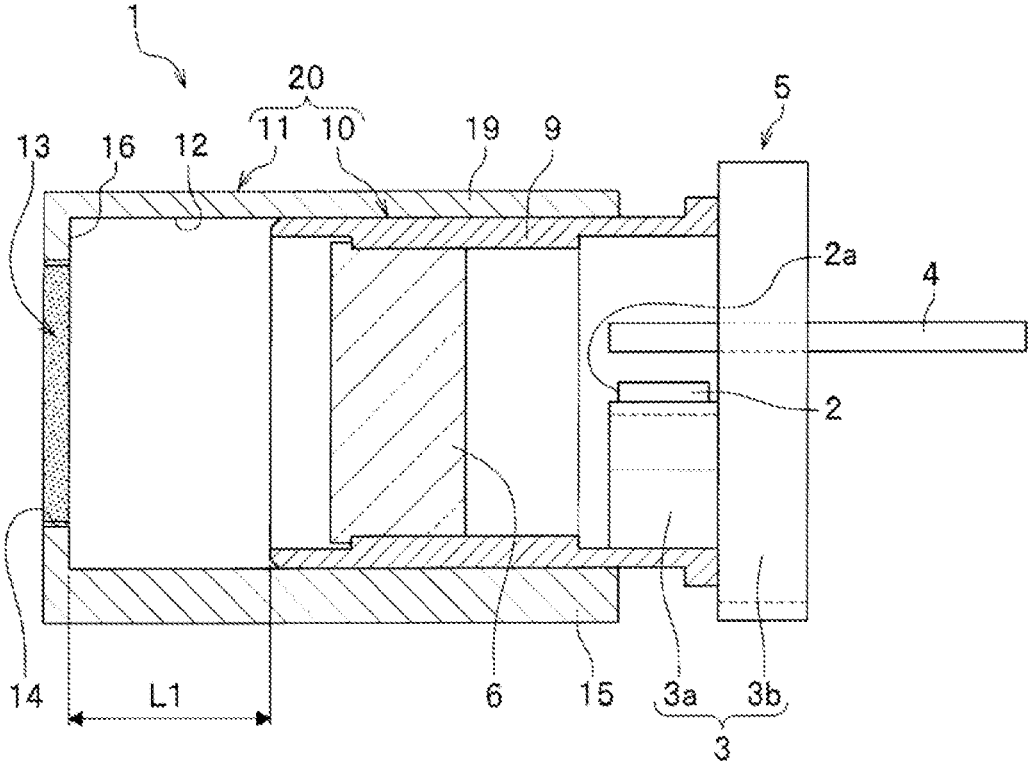
FIG. 2A is a schematic cross-sectional view illustrating an optical member except a laser light source part of the light emitting device shown in FIG. 1.

As shown in FIG. 1 and FIG. 2A, the light emitting device 1 is configured to irradiate laser beam. The light emitting device 1 is, for example, used as a light source of a lighting lamp etc. The light emitting device 1 includes a laser light source 5, an optical member disposed along an optical path of a laser beam of the laser light source 5. The laser light source 5 includes a semiconductor laser element 2, a support member 3 that support the semiconductor laser element 2, and a lead 4 that is disposed penetrating the support member 3 and is electrically connected to the semiconductor laser element 2.

The semiconductor laser element 2 is a semiconductor element that is configured to emit a laser beam. The semiconductor laser element 2 includes a light irradiation surface that is a light irradiation part 2*a* at an end, and has a semiconductor structure, for example, a P-N junction, a double-hetero structure, and/or a quantum well structure. The semiconductor laser element 2 is supported by the support member 3 with the light irradiation part 2*a* facing the opening side of the can case. The semiconductor laser element 2 is configured to irradiate a laser beam which has a predetermined wavelength according to the irradiation object, and is not specifically limited, as long as the semiconductor element can irradiate a laser beam as described above. In the embodiments of the present disclosure, the term "laser beam" is a synonym for "beam light" and can be substituted for "beam light".

The support member 3 includes a stem pillar 3*a* for supporting the semiconductor laser element 2 and a disk-shaped stem base 3*b* disposed at the base end side of the stem pillar 3*a*. The stem pillar 3*a* has a support surface for supporting the semiconductor laser element 2. In the present embodiment, a recessed groove is defined in the center portion of the support surface, and the semiconductor laser element 2 is disposed bridging over the recessed groove. On the stem pillar 3*a*, a semiconductor laser element 2 is supported (mounted) via an adhesive material such as Au—Sn. The stem pillar 3*a* is connected to the stem base 3*b* with its base end side.

The stem base 3*b* is formed in a disk shape and is to connect with the stem pillar 3*a*. The stem base 3*b* and the stem pillar 3*a* are made of, for example, copper or an alloy of Cu that contains at least one of W or Mo, or made of Fe or the like, the materials thereof are not specifically limited as long as the materials are metal materials with good heat dissipation.

The leads 4 are to establish electrical connection with the semiconductor laser element 2 to supply electric current from an external power source. The leads 4 are disposed penetrating the stem base 3*b* so that the leads 4 are approximately in parallel to the stem pillar 3*a*. Note that the leads 4 are insulated from the support member 3. In the figure, the leads 4 are shown in a state of being projected to the inner side of the stem base 3*b* by a predetermined length, but the leads 4 can be arranged on a same plane with the stem base 3*b* as long as electrical connection with the semiconductor laser element 2 can be established.

The optical member 20 is configured to be connected to the support member 3 to cover the semiconductor laser element 2 and to control the beam diameter of the laser beam via the slit 13. In the present embodiment, the optical member 20 includes a can case 9 in which a collimating lens 6 to be installed in an optical path, and a cap 11 provided to cover at least a portion of the can case 9 and to orient a slit 13 on the optical path. In the present embodiment, the can case 9 and the laser light source 5 are combined to form the laser light source 10.

Together with the support member 3, the can case 9 can enclose and hermetically seal the semiconductor laser element 2. The can case 9 is formed in a cylindrical shape to connect its base end side to the stem base 3*b*, and an opening is defined in the other end side to emit a laser beam. In the present embodiment, the can 9 is configured to dispose a collimating lens 6 at the opening side from where the laser beam is emitted. The can case 9 can be made of a metal material which has good connectability with the stem base 3*b* by welding or the like. For example, Cu, Al, Ni, or Fe, or an alloy of each of the aformentioned metals may be employed, but not limited thereto. In addition, the can case 9 may be appropriately provided with a step difference or a recess-protrusion shape on its inner peripheral surface for disposing the collimating lens 6. Note that maintaining air tightness and sealing the air or an inert gas in the can case 9 and tightly held, thus, degradation the semiconductor laser element 2 can be relieved.

The collimating lens 6 is to convert the laser beam from the semiconductor laser element 2 into parallel light. The collimating lens 6 can be a single lens or a composite lens, and is not specifically limited, as long as the lens can condense the laser beam and convert into parallel light. Specific examples of the collimating lens 6 include a silica glass, a sapphire glass, a borosilicate glass, or a resin, and the material thereof is not specifically limited as long as the material can be used for such a structure. The collimating lens 6 is disposed at a position spaced apart from the semiconductor laser element 2. Also, the collimating lens 6 and the opening end of the can case 9 is adjusted to a predetermined distance. The collimating lens 6 may have a structure in which a surface-treatment layer for selectively transmitting light with a specific wavelength is provided. The laser beam that is transmitted through the collimating lens 6 is converted into parallel light and directed toward the slit 13 with a predetermined beam diameter.

Figure 2B:
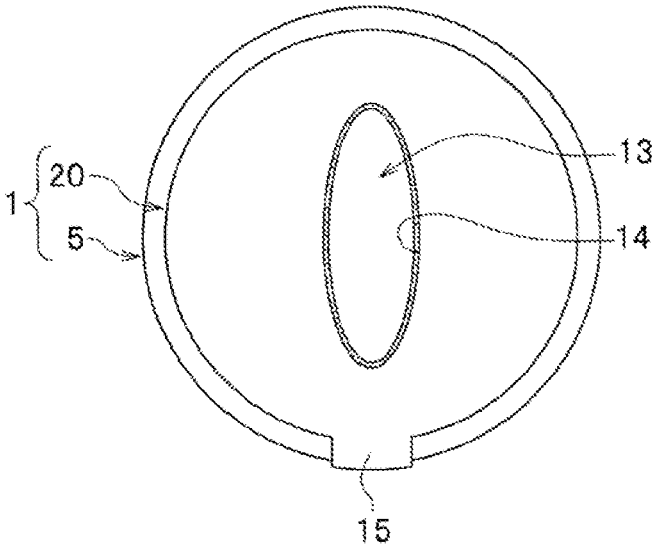
FIG. 2B is a schematic front view of the light emitting device shown in FIG. 2A.

As shown in FIG. 1, FIG. 2A, and FIG. 2B, the cap 11 is to define the beam diameter of the laser beam from the laser light source 5 to a predetermined value. With the cap 11, the slit 13 is oriented on the optical path of the laser beam from the semiconductor laser element 2, to control the beam diameter of the laser beam via the slit 13. In the present embodiment, the cap 11 is formed in a cylindrical shape with a recess defined in the center of the base 19, and the slit 13 is formed in the base 19 defining the bottom of the recess 16. In the present embodiment, in the cap 11, a wavelength converting member 14 to convert the wavelength of the laser beam is applied on the inner wall of the slit 13.

The cap 11 is formed with a size to engage the diameter of the recess defined in the center of the base 19 with the outer diameter of the can case 9. Accordingly, the cap 11 engages the can case 9 covering the opening of the can case 9 while accommodating at least a portion of the can case 9 in the recess 12. The cap 11 is provided so that at the time of engaging the can case 9, the slit 13 and the collimating lens 6 are spaced apart from each other by a distance L1. The cap 11 is disposed so that the slit 13 and the light irradiation part 2*a* of the semiconductor laser element 2 are spaced apart from each other. The protruding portion 15 formed on the peripheral surface of the base 19 is provided for positioning the cap 11 at the time of, for example, setting the cap 11 on the holding structure 30 (see FIG. 4) to be described below, the protruding portion 15 is engaged with the mounting groove 25 to position the cap 11.

The recess 12 is defined in a shape so that at the time of engaged with the can case 9, the center of the slit 13 can be placed on the optical axis of the laser beam emitted from the semiconductor laser element 2. The recess 12 is defined with a size approximately equal or greater than the outer diameter of the can case 9 so as to fit with the can case 9. The cross-sectional shape defining the recess is formed corresponding to the outer shape of the can case 9, and in the present embodiment, formed in a circular shape.

Figure 9:
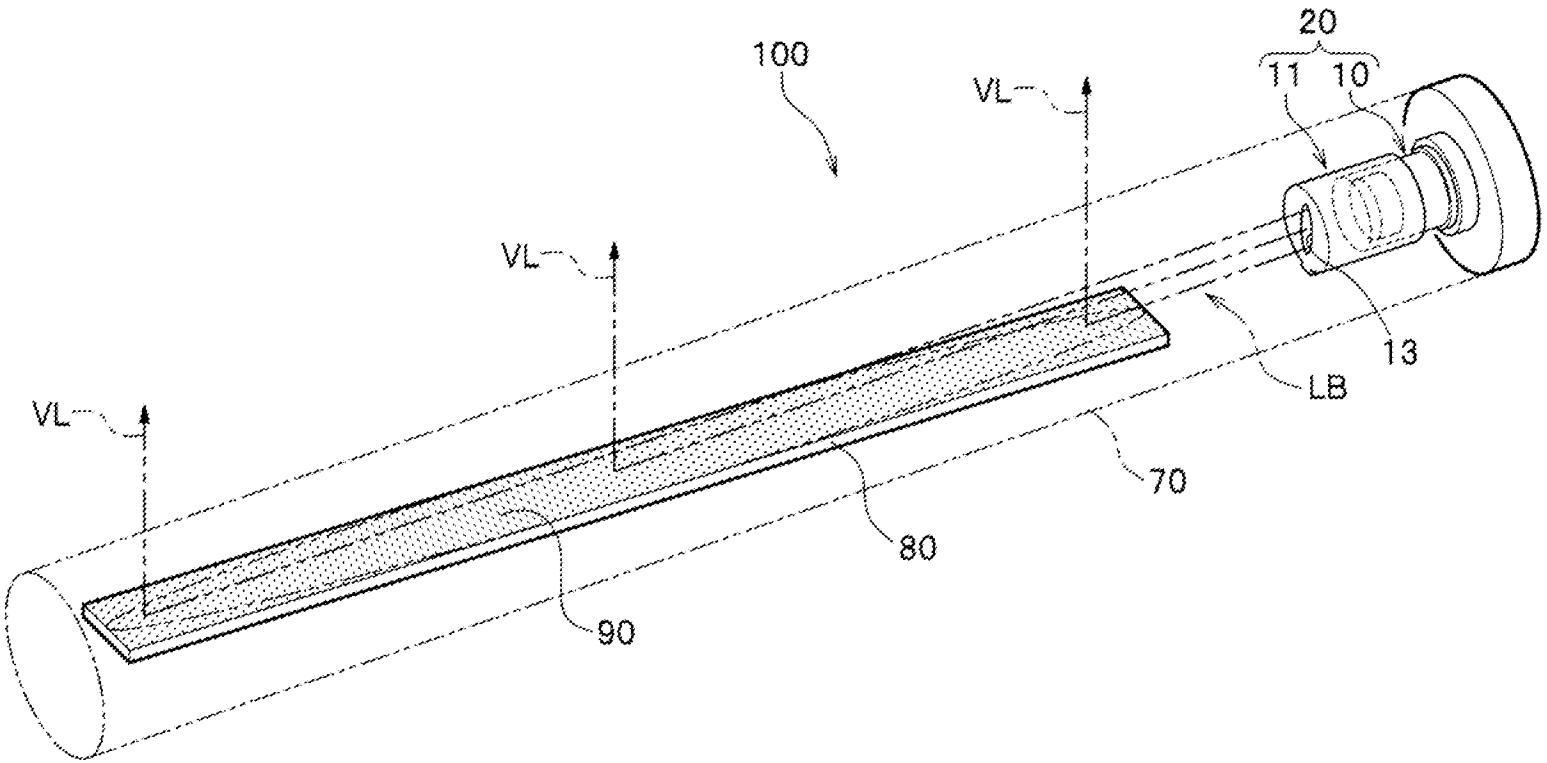
FIG. 9 is a perspective view schematically showing a state in which a light emitting device according to an embodiment of the present disclosure is used in a lighting application.

The slit 13 is to control the beam diameter of the laser beam emitted from the semiconductor laser element 2. The slit 13 is defined by a predetermined shape with respect to an irradiation object. The slit 13 is preferably defined in a shape that allows increasing the irradiation area with respect to the irradiation object. For example, the slit 13 is, in the case of irradiating an elongated member 80 as shown in FIG. 9 to be described below, defined in an elliptic shape with its major axis oriented in a longitudinal direction of the elongated member 80. That is, the slit 13 is oriented so that a lower edge of the elliptical laser beam is irradiated on a proximate side of the longitudinal end of the elongated member, and an upper edge of the elliptical laser beam is irradiated on a distal side of the longitudinal end of the elongated member. Further, as shown in FIG. 3B, the slit 13 is defined so that the laser beam LB within a predetermined beam diameter is allowed to pass through and light which has a different beam diameter than that of the laser beam LB is blocked. That is, the opening width of the slit 13 is defined corresponding to a beam diameter in a range of contour diameter at an intensity position $1/e^2$ (e is the base of natural logarithm) with respect to the center intensity (peak value) of the light intensity distribution of the laser beam LB. That is, the opening width of the slit 13 is defined corresponding to a beam diameter that is $1/e^2$ of the peak value of the Gaussian beam profile). Accordingly, at the slit 13, a portion of outputted light that is less than $1/e^2$ of a foot of the beam and becomes stray light of the laser beam LB can be eliminated. The shape of the slit 13 is, as an example, in the present embodiment, defined in an ellipse having a long diameter oriented perpendicular to the irradiation direction of the laser beam. With defining the slit in an elliptic shape as described above, the laser beam can be efficiently emitted while eliminating a portion of outputted light that is less than $1/e^2$ of a foot of the beam. The slit 13 can also be defined in a shape other than an elliptic shape. The slit 13 is formed as a through-hole penetrating the bottom portion 16 of the recess 12 in its thickness direction.

The wavelength converting member 14 is to convert the wavelength of stray light that occurs at the time of the laser beam emitted from the semiconductor laser element 2 passing through the slit 13 into a light of longer wavelength. That is, upon irradiated with the laser beam, the wavelength converting member 14 converts the wavelength of the laser beam into a visible light of a longer wavelength with high visibility. This phenomenon may also be expressed that upon irradiated by a laser beam that has high directivity, the wavelength converting member 14 converts the laser beam into Lambertian light which is reflected and diffused in all directions. With the wavelength converting member 14, a portion or entire portion of stray laser beam that is leaking from the slit 13 can be converted into a light having a peak wavelength at a longer wavelength side, and thus, the safety can be ensured. The wavelength converting member 14 may be applied on the inner wall defining the slit 13, by using a coating method such as a spray coating method or a brush coating method. In the present embodiment, for the wavelength converting member 14, a YAG fluorescent material that can convert an ultraviolet laser beam or a blue laser beam into a white light is used. The wavelength converting member 14 is disposed on the inner wall defining the slit 13, which allows converting the leaking laser beam into a visible light of a longer wavelength with high visibility. Thus, the laser beam appropriately passing through the slit 13 can be irradiated while maintaining rectilinear advancing property of the laser beam.

Figure 3A:
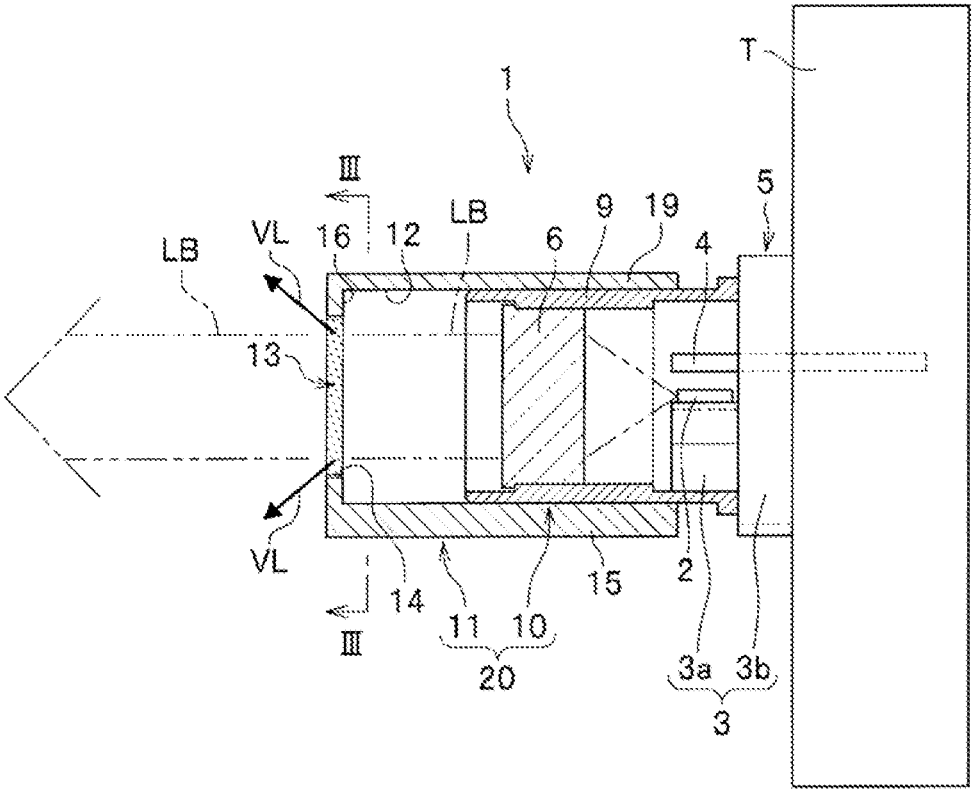
FIG. 3A is an explanatory diagram schematically showing a state of laser beam and leaking stray light of the light emitting device shown in FIG. 1.
Figure 3B:
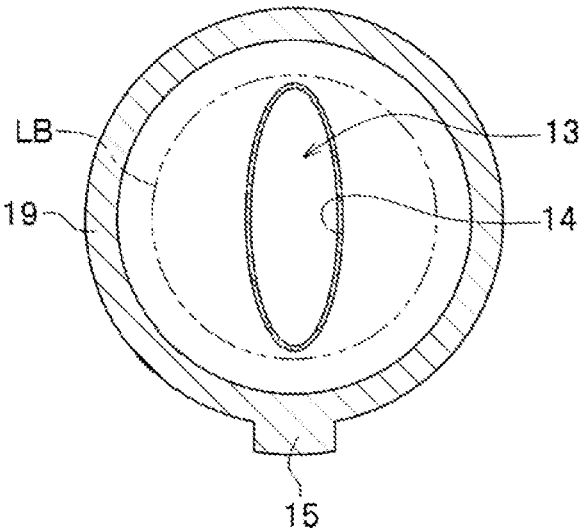
FIG. 3B is an explanatory diagram illustrating a relationship between the laser beam and the slit on a cross section taken along line of FIG. 3A.

In the case of using the light emitting device 1 provided with the optical member 20 constituted as described above installed on a base member T or the like, as shown in FIG. 3A, the semiconductor laser element 2 can be hermetically sealed while converting the laser beam LB into parallel light, thus, the laser beam can be irradiated with its beam diameter controlled by the slit 13. Further, the optical member 20 allows the laser beam passing through the slit 13 to be irradiated while maintaining rectilinear advancing property of the laser beam, while converting stray light occurred at the slit 13 into a visible light VL with high visibility, thus, safety can be secured.

Figure 4:
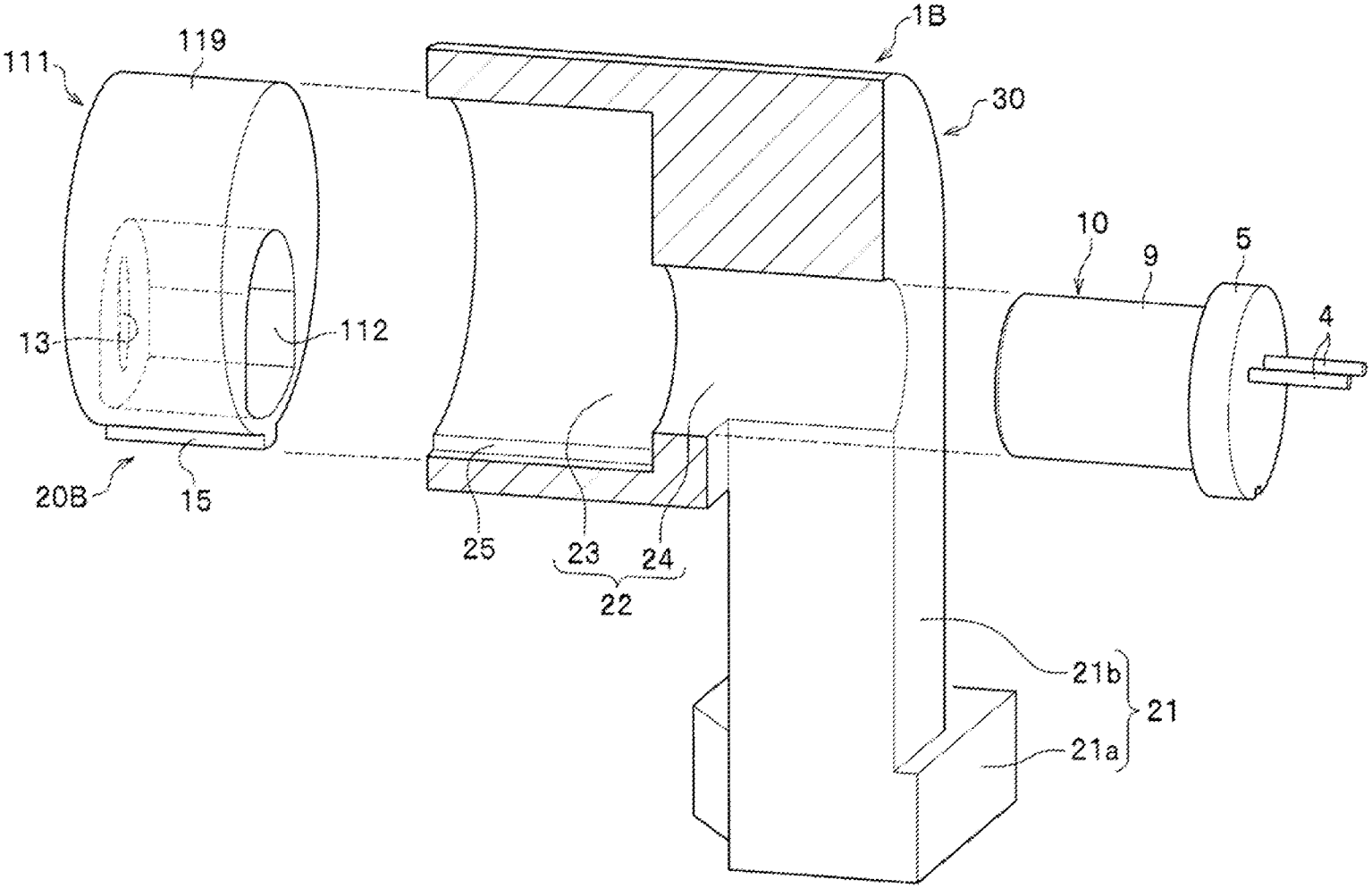
FIG. 4 is a schematic exploded perspective view of a light emitting device disclosed as another example of an embodiment of the present disclosure with a cross-sectional view of a holding structure.
Figure 5A:
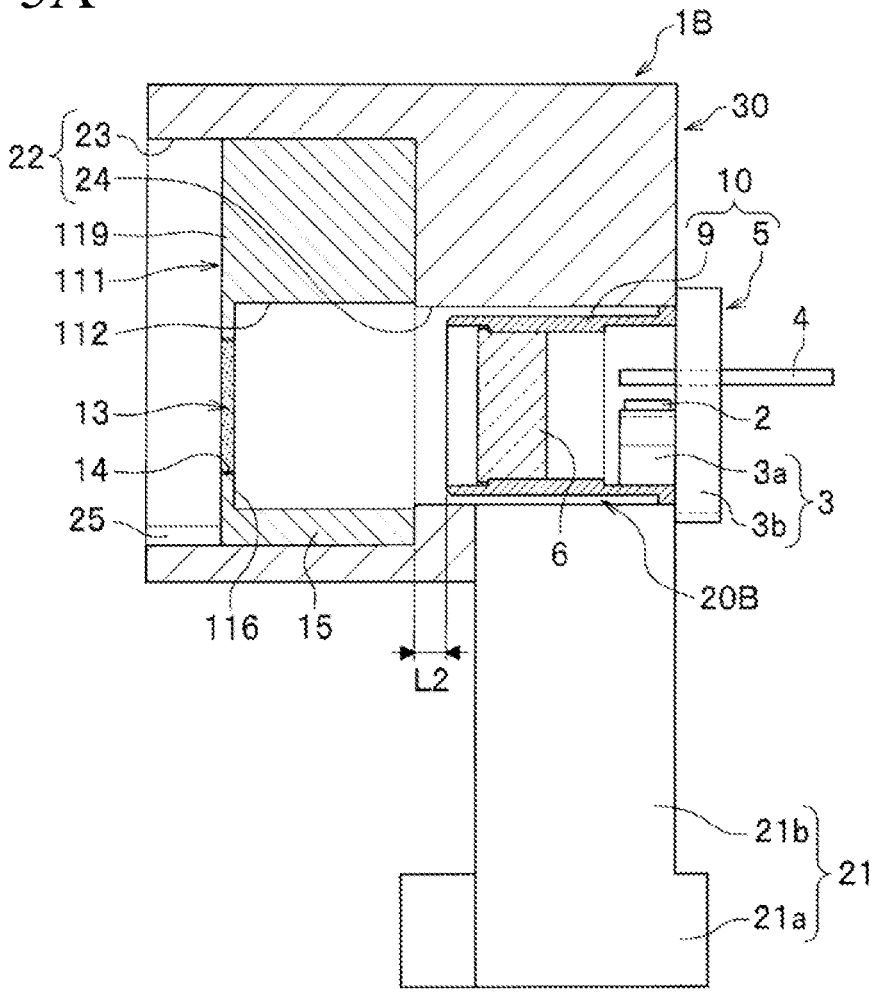
FIG. 5A is a partially sectional schematic view of the optical member and the holding structure of the light emitting device shown in FIG. 4.
Figure 5B:
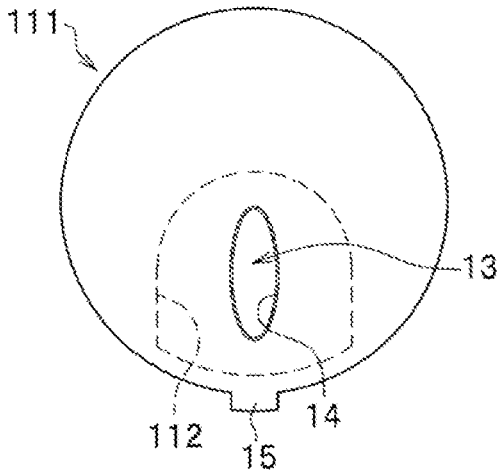
FIG. 5B is a front view of a cap of an optical member used in the light emitting device shown in FIG. 4.

The light emitting device 1 is illustrated with the optical member 20 provided with a recess 12 in a center portion of the base 19, but as shown in FIG. 4, in the cap 111, the recess 112 may be defined at an eccentric position from the center of the base 119. That is, as shown in FIG. 4, FIG. 5A, and FIG. 5B, the light emitting device 1B has a configuration in which the cap 111 defining the recess 112 at an eccentric position from the center of the base 119 is employed. The light emitting device 1B is constituted so that the cap 111 of the optical member 20B and the can case 9 of the optical member 20B are provided as separate parts, and the can case 9 and the laser light source part 5 are held integrally by the holding structure 30. In the description below, the same reference numerals will be applied to the configurations described above and description thereof will be appropriately omitted.

The optical member (cap) 20B includes a cap 111 defining the recess 112 at an eccentric position in the base 119 and the can case 9 provided with the collimating lens 6 and arranged spaced apart from the cap 111. The laser light source part 5 is held by the holding structure 30 in a state of being coupled to the can case 9. The cap 111 includes a disk-shaped base 119, a recess 112 defined at an eccentric position from the center of the base 119, a slit 13 defined in the bottom surface 116 defining the recess 112, a wavelength converting member 14 disposed on the inner surface defining the slit 13, and a protruding portion 15 formed on the outer periphery of the base 119.

The base 119 is formed in a thick disk shape made of a metal or a resin. The base 119 is formed so that the protruding portion 15 disposed on the peripheral surface to engage the mounting groove 25 of the holding structure 30. The base 119 is preferably made of a metal or a heat-resistant resin that is resistant to degradation by the heat of the laser beam emitted from the laser light source part 5. As shown in FIG. 4 and FIG. 5B, the recess 112 is defined in a shape in which, in a cross section, ends of a semicircular curve having a smaller curvature radius located at the center side are connected with ends of a circular curve having a larger curvature radius located at outer periphery side are connected by straight lines. Defining the recess 112 by a combination of curves and straight lines in a cross section allows for a reduction in a planar dimension on the bottom surface defining the recess 116 that is other than the slit and is irradiated by the laser beam emitted from the laser light source part 5. The shape defining the recess 112 as described above also allows for enhancing stress relaxation at the time of expansion caused by the heat of the laser beam. Further, defining the recess 112 by a combination of curves and straight lines allows for an allowance in engaging with the can case 9 of a diameter in a certain range.

The cap 111 formed as described above, is designed so that the elliptic slit 13 is oriented to longitudinally long at the time of engaging the protruding portion 15 of the base 119 with the mounting groove part 25 of the holding structure 30.

As shown in FIG. 4, the holding structure 30 is configured to assemble the cap 111 of the optical member 20B and the laser light source part 5 integrally coupled to the can case 9 of the optical member 20B (the can case 9 and the laser light source part 5 may be referred to collectively as a "laser light source device 10 below). As shown in FIG. 4 and FIG. 5A, the holding structure 30 is configured so that upon accommodating the cap 111 and the laser beam 10, the slit 13 defined in the cap 111 is oriented on the optical path of the laser beam emitted from the semiconductor laser element 2. The holding structure 30 includes a leg portion 21 for fixing the holding structure 30 to a predetermined mounting position and a fitting portion 22 provided at an upper end of the leg portion 21.

The leg portion 21 includes a fixing portion 21*a* provided at its lower end for fixing to a predetermined position, and a support leg portion 21*b* that has a cross sectional dimension smaller than the fixing portion 21*a*. The leg portion 21 supports the fitting portion 22 at an end of the support leg portion 21*b* at a predetermined height. The fitting portion 22 includes an optical member mounting portion 23 defined in a recessed shape for engagingly attaching the optical member 20B by the mounting groove 25, and an optical member mounting portion 24 that is provided at a position eccentrically facing the optical member mounting portion 23 and is defined in a recessed shape, for engagingly attaching the laser light source device 10. Then, the optical member mounting portion 23 and the light source mounting portion 24 are formed communicated with each other.

The holding structure 30 is configured so that the optical member 20B is fittingly attached to the optical member mounting portion 23 so that the protruding portion 15 is engaged in the mounting groove portion 25, and that the slit 13 is oriented on the optical path of the laser light source device 10 upon fittingly attaching the laser light source device 10 to the light source mounting portion 24. With this arrangement, the cap 111 of the optical member 20B attached to the holding structure 30 and the laser light source device 10 are installed spaced apart from each other by a distance L2 along the optical axis direction.

In the light emitting device 1B, the laser light source device 10 and the cap 111 of the optical member 20B are installed via the holding structure 30, which allows for easy orientation in the optical axis direction. Also, the wavelength converting member 14 is disposed on the inner wall defining the slit 13, so that the laser beam leaking from the slit 13 can be converted into a visible light of a longer wavelength with high visibility, and thus the safety can be enhanced. Further, the light emitting device 1B can maintain rectilinear advancing property of the laser beam that passing through the slit 13. Moreover, the light emitting device 1B employs the holding structure 30 that facilitates positional adjustment of the laser light source device 10 and installation to a predetermined location.

Figure 6:
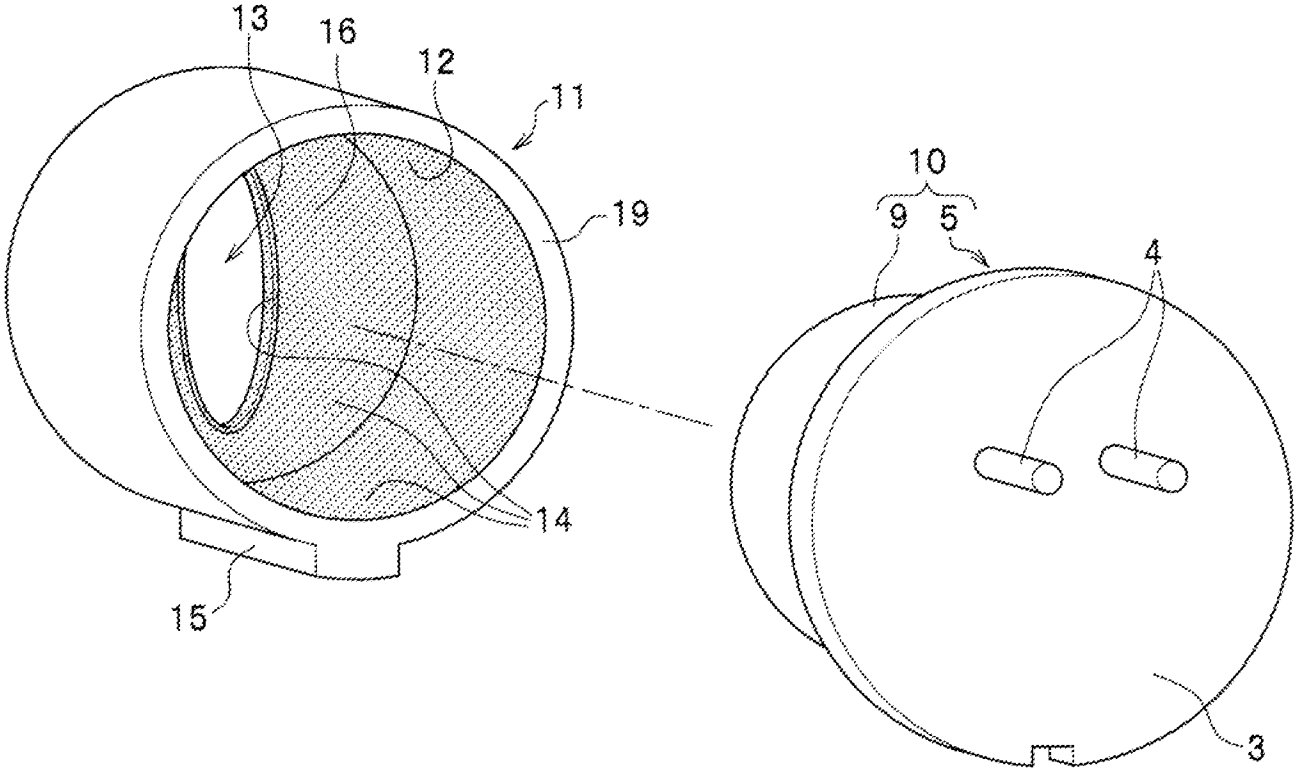
FIG. 6 is a schematic exploded perspective view showing a state in which a wavelength converting member is disposed on an inner side of the recess of the cap, in a light emitting device disclosed as another example of an embodiment of the present disclosure.
Figure 7:
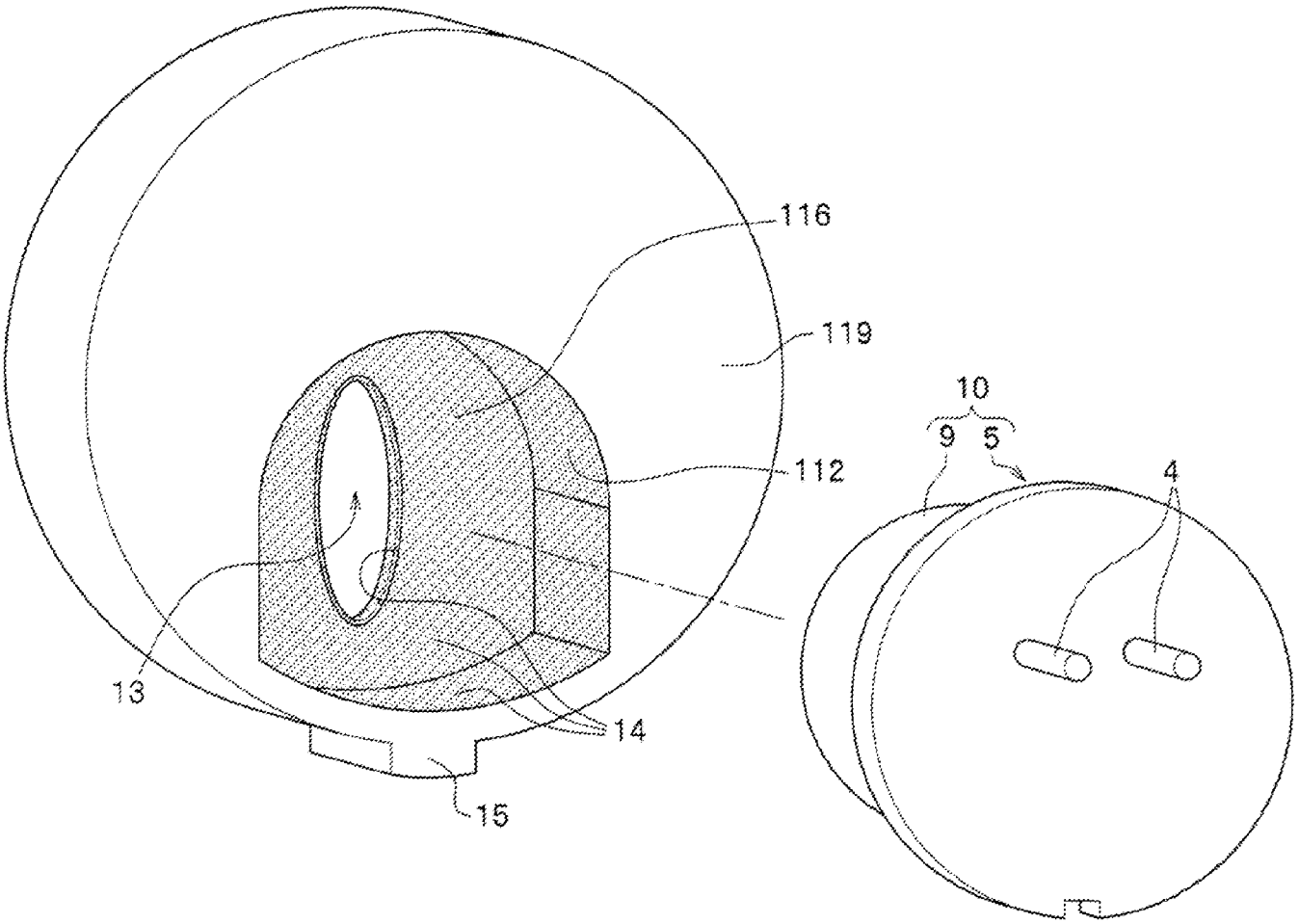
FIG. 7 is a schematic exploded perspective view showing a state in which a wavelength converting member is disposed on an inner side of the recess of the cap, in a light emitting device disclosed as another example of an embodiment of the present disclosure.

In the above description, a configuration in which the can case 9 of the laser light source device 10 and the cap 111 are installed spaced apart from each other is illustrated, but a configuration may be such that the can case 9 and the cap 111 are held overlapped with each other by the holding structure 30. The wavelength converting member 14 is illustrated as being disposed only on the inner wall defining the slit 13, but for example, as shown in FIG. 6 and FIG. 7, the wavelength converting member 14 may also be disposed on the inner wall defining the slit 13 and the inner side of the recesses 12, 112. That is, the wavelength converting member 14 can be disposed on the bottom surface and side surfaces defining the recess, which are in other words the inner side surfaces defining the recesses 12, 112. As described above, providing the wavelength converting member 14 on the inner wall defining the slit 13 and on the inner surfaces defining the recesses 12, 112 allows for more reliably converting the laser beam that is leaking from the slit 13 as stray light into a visible light with high visibility, thus the safety can be further enhanced.

Figure 8:
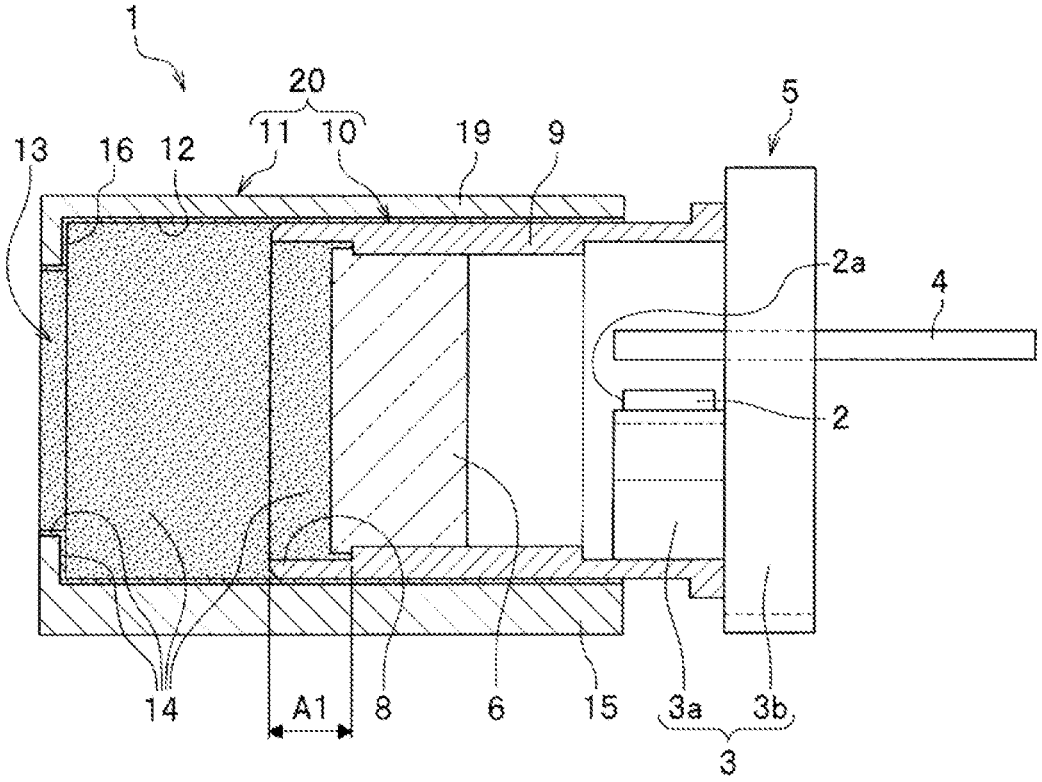
FIG. 8 is a schematic cross-sectional view illustrating a state of the light emitting device shown in FIG. 6, in which a wavelength converting member is also disposed on an inner side of a can case at a location between the opening end of the can case and the collimating lens.

Further, as shown in FIG. 8, the wavelength converting member 14 may be disposed also on the area A1 that is a portion of the inner side surface of the can case 9. Providing the wavelength converting member 14 on the area A1 of the can case 9 allows for conversion of the leaking stray light into a visible light with high visibility at higher probability, thus the safety can be further enhanced. As described above, the location to dispose the wavelength converting member 14 may either be on an inner wall defining the slit 13, on an inner wall defining the slit 13 and on the inner surface defining the recess 12 or 112, on the inner wall defining the slit 13 and the area A1, or on an inner wall defining the slit 13, on the inner surface defining the recesses 12 or 112, and the area A1.

The light emitting devices 1 and 1B can be used, for example, in a lighting system. In the below, an exemplified configuration of applying the light emitting device 1 in a lighting apparatus 100 will be described with reference to FIG. 9. The lighting apparatus 100 includes the light emitting device 1 equipped with the laser light source device 10 and the optical member 20, and an elongated member 80 that is coated with a wavelength converting member 90 and is disposed on the optical path of the laser beam emitted from the laser light source device 10. The light emitting device 1 is mounted on a disk-shaped base member that is provided with a heat sink. The lighting apparatus 100 may have a configuration in which a cylindrical cover member 70 is provided. In the lighting apparatus 100, the surface of the elongated member 80 that is provided with the wavelength converting member 90 and the optical axis of the laser beam emitted from the light emitting device 1 are arranged in a positional relationship so that either one or both are inclined and cross each other. Accordingly, in the lighting apparatus 100, the laser beam LB emitted from the light emitting device 1 is irradiated on the wavelength converting member 90, which may be a YAG fluorescent material, applied on the elongated member 80 to convert the wavelength of the light, for example into a white light, and emitted to outside through the cover member 70. Thus, the lighting apparatus 100 can be used for illumination.

Moreover, in the present embodiment, the light emitting device 1 is provided with a slit 13 defined in an elliptic shape, so that the laser beam LB is irradiated on an elongated elliptic irradiation surface on an elongated rectangular surface of the wavelength converting member 90 applied on the elongated member 80. That is, with the slit 13 provided in the light emitting device 1, a lower edge of the elliptical laser beam is irradiated on a proximate side of the longitudinal end of the elongated member 80, and an upper edge of the elliptical laser beam is irradiated on a distal side of the longitudinal end of the elongated member 80. The opening width of the slit 13 is defined corresponding to a beam diameter at an intensity position $1/e^2$ (e is the base of natural logarithm) with respect to the center intensity of the light intensity distribution of the laser beam LB. Thus, a portion of outputted light that is less than $1/e^2$ of a foot of the beam and becomes stray light of the laser beam LB is eliminated.

With the arrangement as described above, even in the case where the cover member 70 is a light-transmissive member, the wavelength of stray light leaking from the slit 13 of the light emitting device 1 can be converted into a visible light with high visibility at a longer wavelength side by the wavelength converting member 14 (see FIG. 1), so that the safety can be maintained. Moreover, in the lighting apparatus 100, the laser beam LB that passes through the slit 13 reaches the wavelength converting member 90 without its wavelength being converted on the optical path to the wavelength converting member 90, so that the rectilinear propagation characteristics of the laser beam LB can be maintained.

The light emitting device 1 (1B) described above may have configurations illustrated below. In the light emitting device 1 (1B), the optical member 20 (20B) may have the cap 11 (111) or the can case 9 formed in an appropriate shape that allows orientation of the slit 13 on the optical path of the laser beam, for example, the shape may be a planar shape, a shape with a C-shaped cross section, a shape with an U-shaped cross section, or the like. That is, the optical member 20 (20B) may have any appropriate shape that allows orientation of the slit 13 on the optical axis of the laser beam and that can prevent irradiation of the laser beam from portions other than the slit 13.

The recess 12 (112) may be defined in a shape with a circular cross section corresponding to the outer shape of the can case 9, or in other appropriate shape. The slit 13 is defined in a shape corresponding to the irradiation object, and a shape other than the elliptic shape described above, for example, a circular shape, a rectangular shape, an oval shape, a diamond shape, a triangular shape, or the like may be employed. The opening width of the slit is described assuming the beam diameter at an intensity of $1/e^2$ (e is the base of natural logarithm), but the opening width of the slit 13 may be either greater or smaller with respect to the beam diameter, as long as it is in a range in that the laser beam LB can irradiated on the inner wall defining the slit 13.

Further, as the wavelength converting member 14, a fluorescent material may be directly applied, or a fluorescent material may be applied with the use of a binder that is made of an organic material such as a silicone resin or an epoxy resin, or an inorganic material that contains at least one of glass, $SiO_2$, AlN, $ZrO_2$, SiN, $Al_2O_3$, and GaN. The wavelength converting member 14 may be a cadmium zinc sulfide-based fluorescent material activated with copper, a YAG-based fluorescent material activated with zinc or cerium, or a LAG-based fluorescent material activated with cerium, that is appropriately employed according to the laser beam emitted from the semiconductor laser element 2.

Also, in the light emitting device 1 (1B), the laser light source device 10 with a structure that includes a collimating lens 6 is illustrated, but a structure in which a collimating lens 6 is not placed on the optical path can also be employed. Further, in the description above, the beam diameter of the laser beam LB is assumed greater than the slit 13, but the beam diameter may be similar to the slit 13. In the light emitting device 1, the cap 11 and the can case 9 are illustrated as separate parts, and in the light emitting device 1B, the cap 111 and the can case 9 are illustrated as separate parts, but the cap 11 (111) and the can case 9 may be integrated. Further, in the light emitting device 1 (1B) that is used installed in the holding structure, a heat radiation structure such as a heat sink may be provided. It is to be understood that although the present invention has been described with regard to preferred embodiments thereof, various other embodiments and variants may occur to those skilled in the art, which are within the scope and spirit of the invention, and such other embodiments and variants are intended to be covered by the following claims

What is claimed is:

1. A light emitting device comprising:

a laser light source part and an optical member provided with a slit;

the optical member being arranged in the laser light source part with the slit oriented on an optical path of a laser beam; and a wavelength converting member for wavelength converting the laser beam into visible light at a long wavelength side being disposed on an inner surface defining the slit.

2. The light emitting device according to claim 1, wherein the optical member being a cap provided with a recess and is configured to cover at least a light irradiation part of the laser light source part, the slit being formed in a bottom of the recess cap, and the wavelength converting member is disposed in an inner side of the recess.

3. The light emitting device according to claim 2, wherein in the cap, the slit and the light irradiation part of the laser light source part are spaced apart from each other.

4. The light emitting device according to claim 1, further comprising a collimating lens disposed on the optical path between the laser light source part and the slit.

5. The light emitting device according to claim 2, further comprising a collimating lens disposed on the optical path between the laser light source part and the slit.

6. The light emitting device according to claim 3, further comprising a collimating lens disposed on the optical path between the laser light source part and the slit.

7. The light emitting device according to claim 1, wherein the opening width of the slit is defined by a beam diameter that correspond to an intensity of 1/e2 in terms of the central intensity of light intensity distribution of the laser beam.

8. The light emitting device according to claim 2, wherein the opening width of the slit is defined by a beam diameter that correspond to an intensity of 1/e2 in terms of the central intensity of light intensity distribution of the laser beam.

9. The light emitting device according to claim 3, wherein the opening width of the slit is defined by a beam diameter that correspond to an intensity of 1/e2 in terms of the central intensity of light intensity distribution of the laser beam.

10. The light emitting device according to claim 4, wherein the opening width of the slit is defined by a beam diameter that correspond to an intensity of 1/e2 in terms of the central intensity of light intensity distribution of the laser beam.

11. The light emitting device according to claim 5, wherein the opening width of the slit is defined by a beam diameter that correspond to an intensity of 1/e2 in terms of the central intensity of light intensity distribution of the laser beam.

12. The light emitting device according to claim 6, wherein the opening width of the slit is defined by a beam diameter that correspond to an intensity of 1/e2 in terms of the central intensity of light intensity distribution of the laser beam.

* * * * *